United States Patent [19]

Hosokoshi et al.

[11] Patent Number: 4,777,401

[45] Date of Patent: Oct. 11, 1988

[54] COLOR PICTURE TUBE HAVING A FACE PANEL WITH AN OUTER FACE HAVING A HYPERBOLIC CURVATURE

[75] Inventors: Kakuichiro Hosokoshi, Neyagawa; Shigeya Ashizaki, Takatsuki; Osamu Konosu, Nagaokakyo; Osamu Adachi, Osaka, all of Japan

[73] Assignee: Matsushita Electronics Corporation, Kadoma, Japan

[21] Appl. No.: 4,491

[22] Filed: Jan. 20, 1987

[30] Foreign Application Priority Data

Jan. 30, 1986 [JP] Japan ..... 61-18441

[51] Int. Cl.[4] ..... H01J 29/10; H01J 29/86

[52] U.S. Cl. ..... 313/461; 313/477 R; 313/408; 220/2.1 A

[58] Field of Search ..... 313/408, 461, 477 R, 313/478; 220/2.1 A, 2.3 A, 2.1 R; 358/250

[56] References Cited

U.S. PATENT DOCUMENTS 4,535,907 8/1985 Tokita et al. ..... 220/2.1 A
4,537,322 8/1985 Okada et al. ..... 220/2.1 A
4,570,101 2/1986 Campbell ..... 313/461

FOREIGN PATENT DOCUMENTS 0119317 9/1984 European Pat. Off. .
0146926 7/1985 European Pat. Off. .
2136198 9/1984 United Kingdom .
2136199 9/1984 United Kingdom .
2147142 5/1985 United Kingdom .

OTHER PUBLICATIONS

National Technical Report (Japan), vol. 33 No. 2, Kitagawa et al., "Hyperbolic Flat Art Color Picture Tube Series," pp. 153–167, 4/87.

National Technical Report (Japan) vol. 33 No. 2, Adachi et al., "43-Inch Super-Large Color CRT", pp. 168–175, 4/87.

*Primary Examiner*—David K. Moore
*Assistant Examiner*—K. Wieder
*Attorney, Agent, or Firm*—Cushman, Darby & Cushman

[57] ABSTRACT

In a color picture tube, curvature of outside face of said face panel is defined by $$Z = \frac{\sqrt{A^2 + r^2} - A}{B}$$

wherein Z is a distance in a direction of tube axis from an X-Y plane tangential at the center of the face, r is a distance from the center of the face panel to said point therealong, and A and B are constants of positive integers, respectively; thus the face panel excludes point of inflection and the reproduced picture thereon has a flat appearance, without trouble of undesirable doming of shadow mask.

5 Claims, 4 Drawing Sheets

COLOR PICTURE TUBE HAVING A FACE PANEL WITH AN OUTER FACE HAVING A HYPERBOLIC CURVATURE

FIELD OF THE INVENTION AND RELATED ART STATEMENT

1. Field of the Invention

The present invention relates generally to a color picture tube, and more particularly relates to a large size type color picture tube with a shadow mask.

2. Description of the Related Art

In the conventional shadow mask type color picture tube, the curved face of the shadow mask to be mounted therein in an assemblage is formed generally in a part of sphere shape, which is advantageous in forming and in mechanical strength. Since the inside face and outside face of rectangular face panel of the color picture tube, whereunder the shadow mask is disposed, is to be shaped almost similar to the curved face of the shadow mask, dispositions of phosphor dots or phosphor stripes to form a phosphor layer can be made appropriately, and contour lines of the rectangular face panel of the prior art are concentric circles as shown in FIG. 5.

On the other hand, in order to comply with recent demand for near-flat face panel of color picture tube, especially for color picture tubes of a large size, a proposal is made to increase radius of curvature on outside face of the face panel as large as 2 times of that of the conventional one. Another proposal is that, Japanese published unexamined patent application No. Sho 60-72146, curvature in a direction of shorter axis of the face panel is selected to be larger by 10% than the curvature in a direction of longer axis of the face panel, thereby to provide, in appearance, more flat reproduced picture than the conventional one on the spherically shaped face panel.

There is a problem, however, that the above-mentioned improved type color picture tubes having more flat face panel necessitates use of shadow mask having more flat shape than the conventional one, and such more flat type shadow mask is liable to cause more doming, namely, local protrusion of a small area of the shadow mask resulting from higher temperature by more dense bombardment of electrons, thereby to generate discoloration due to misregistration. The above-mentioned doming phenomenon is explained more in detail: electron beam for bright part of reproduced image becomes more dense, thereby excessively heating a local part corresponding to the bright area of the image, and thereby, heat expansion owing to the excessive heating in the local area makes the local protrusion of the shadow mask 1*a* of FIG. 6 from other parts 1*b* toward the inside face of the face panel 2. As a result, the electron beams passing through the apertures of the domed part of the shadow mask 1*a* can not rightly hit the intended phosphor dots or phosphor stripes, thereby making misregistration, hence discoloration. It is experimentally known that the amount of the protrusion $\delta$ is roughly proportional to radius of curvature of the shadow mask, and accordingly, hitherto it is impossible to adopt a large radius of curvature even in a local part.

OBJECT AND SUMMARY OF THE INVENTION

The object of the present invention is to provide an improved color picture tube whereon reproduced image is relatively flat in appearance and that the discoloration owing to the aforementioned doming phenomenon is sufficiently prevented.

A color picture tube in accordance with the present invention comprises:

a vacuum enclosure having a face panel of a substantially rectangular shape having color phosphor dots or stripes on an inside face thereof, a shadow mask disposed in the enclosure with a predetermined gap to the inside face of the face panel, and electron emission means including control means for controlling electron beam density, and the improvement is that outside face of the face panel has a curvature without point of inflection and is defined by $$Z = \frac{\sqrt{A^2 + r^2} - A}{B}$$

wherein

Z is a distance in a direction of tube axis from a plane tangential at the center of the outside face to a point on the outside face, r is a distance from the tube axis to the point therealong, and A and B are values independent of r, respectively.

The above-mentioned curved face panel has flat appearance as a whole, and that the curved face has maximum curvature at the center part and the curvature gradually decreases towards the peripheral parts of the face panel, without having point of inflection. Accordingly, the face plate in accordance with the present invention has gentle shape as a whole and undesirable doming is effectively prevented, and that appearance of the reproduced image does not substantially has distortion unlike prior art color picture tube wherein face panel has point of inflections. Since peripheral parts of the shadow mask are subject to absorption of heat through frame of shadow mask and subject to mechanical suppression of distortion by means of the frame, even though the curvatures decreasing towards the peripheral parts of the shadow mask the undesirable doming phenomenon is effectively suppressed.

DESCRIPTION OF THE PREFERRED EMBODIMENTS

Figure 1:
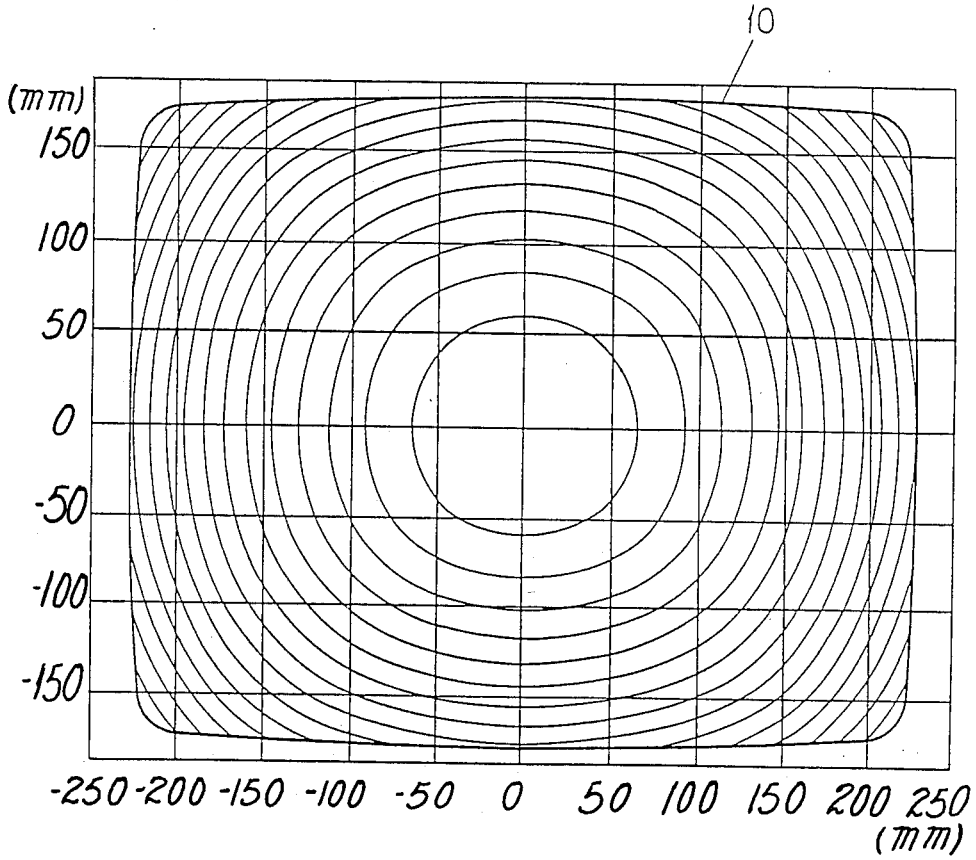
FIG. 1 is a contour line diagram of a preferred embodiment of the present invention.

Rectangular shape face panel of a color picture tube embodying the present invention has a curved surface represented by contour lines shown in FIG. 1. To explain the above by way of FIG. 2 and FIG. 3, the X-Y-Z coordinate is considered wherein in Z-axis is the tube axis, X-axis is in the direction of horizontal axis of the rectangular face panel and Y-axis is in the direction of the vertical axis of the rectangular face panel and center of the outer surface of the face panel 10 is defined as a point O. Then, on the outside face of the panel, a first point which is apart from the center point O by a distance r and is on X-Z plane is defined as a point $P_X$, a second point which is apart from the center point O by a distance r and is on Y-Z plane is defined as a point $P_Y$, and a third point which is apart from the center point O by a distance r and on diagonal-line-Z-axis plane is defined as point $P_D$.

Furthermore, the face panel has such a configuration that the curvature at the Z-axis is maximum at the center O, and the curvature gradually and monotonously decreases towards the peripheral parts. By defining curvature at points of distance r from the Z-axis on the X-Z plane is $C_{Xr}$, curvature at points of distance r from the Z-axis on the Y-Z plane is $C_{Yr}$, and curvature at points of distance r from the Z-axis on the diagonal-Z plane is $C_{Dr}$, these curvatures $C_{Yr}$, $C_{Xr}$ and $C_{Dr}$ are selected to have the following relation substantially over the whole part of the face:

$$C_{Yr} > C_{Xr} > C_{Dr},$$

thereby to form a monotonously convex curved face which has no point of inflection.

Figure 2:
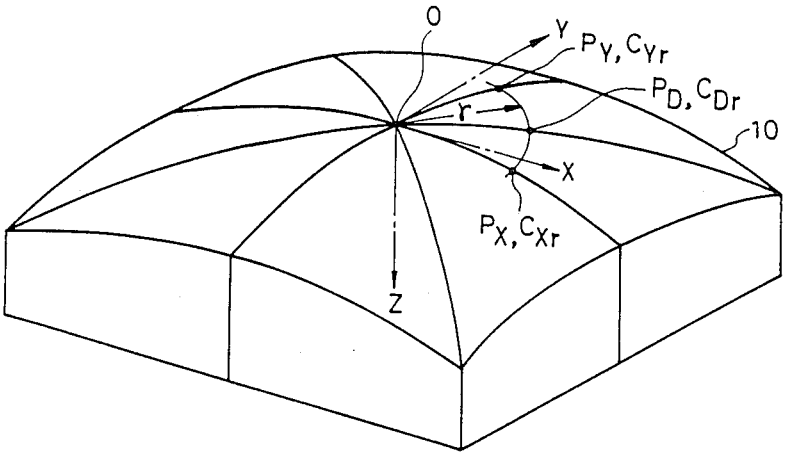
FIG. 2 is a perspective view of the face panel embodying the present invention.
Figure 3:
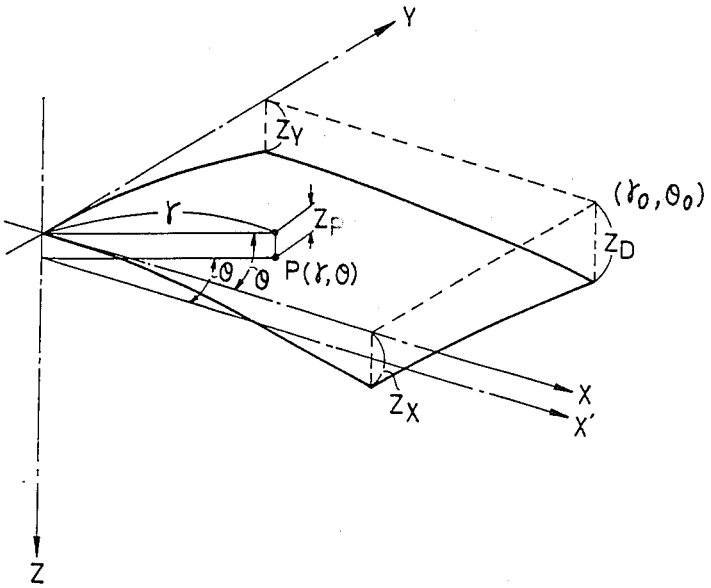
FIG. 3 is a perspective diagram showing only a first quadrant of the face panel.

FIG. 3 illustrates in more detailed way the configuration of the curved outside face of the face plate of FIG. 2, by showing only a first quadrant of the curved face. Then, by defining that an angle $\theta$ is that made between a normal line from the point P to the Z-axis and X-Z plane, and defining that axial distance Zp is a distance from the point P on the outside face of the face panel to the X-Y plane which is tangential at the center point O to the curved face of the outside face, that axial distance $Z_X$ is a distance from a peripheral end point on the outside face and on the X-Z plane to the X-Y plane, that axial distance $Z_Y$ is a distance from a point at the peripheral end of the outside face and on the Y-Z plane and axial distance $Z_D$ is a distance from a point on the corner peripheral point of the outside face which is on the diagonal-line-Z-axis plane to the X-Y plane, the outside face is defined by the following relation (1).

$$Z_P = \frac{\sqrt{A^2 + r^2} - A}{B}. \tag{1}$$

And more preferably, the outside face is further defined by $$A = 1/\sum_{i=0}^{n} A_i \cos(2i\theta) > 0 \tag{2}$$

$$B = \sum_{i=0}^{n} B_i \cos(2i\theta) > 0, \tag{3}$$

wherein i=0, 1, 2, . . . n are positive integers, $A_i$ and $B_i$ are constants and A and B are variants which are dependent only on the angle $\theta$. The variants A and B are each other dependent, and when an axial distance $Z_D$ is given for a certain point on a diagonal peripheral end point having a coordinates of ($r_0$, $\theta_0$), the following relation is obtainable:

$$B = \frac{\sqrt{A^2 + r_0^2} - A}{Z_D}. \tag{4}$$

The number n is a positive integer which is 10 or lower, and in ordinary cases 6 or lower value of n gives fairly good curved surface. This curved surface gives hyperbolic lines on cross-sectional planes which include Z-axis as follows. By modifying the equation (1), the following relation holds:

$$\frac{r^2}{A^2} - \left(\frac{B}{A}\right)^2 \left(Z_P + \frac{A}{B}\right)^2 = 1. \tag{5}$$

This equation designates a hyperbolic curve which has its mathematical center point apart upwards by a distance A/B from the point O along Z-axis, i.e., at the point of r=0 and Z,32 −A/B.

An actual working example embodied for a 21 inch type color picture tube is as follows:

| | |
|---|---|
| major radius | 206.7 (mm) |
| minor radius | 155.9 (mm) |
| half-diagonal length | 257.5 (mm) |
| axial distance at diagonal end of the outside face ($Z_D$) | 28.765 (mm) |

$A = 1/\{A_0 + A_1\cos(2\theta) + A_2\cos(4\theta) + A_3\cos(6\theta) + A_4\cos(8\theta)\}$
$A_0 = 1.75176 \times 10^{-3}$ (l/mm), $A_1 = 9.845156 \times 10^{-5}$ (l/mm)
$A_2 = -1.44521 \times 10^{-3}$ (l/mm), $A_3 = 7.9944266 \times 10^{-5}$ (l/mm)
$A_4 = -1.311048 \times 10^{-5}$ (l/mm)
$B = B_0 + B_1\cos2\theta + B_2\cos4\theta + B_3\cos6\theta + B_4\cos8\theta,$ by substituting the above-mentioned values of $r_0$, $Z_D$ and A, the followings are obtained.

| | |
|---|---|
| $B_0 = 1.734462$, | $B_1 = 0.2$ |
| $B_2 = -1.434462$, | $B_3 = -3.57965 \times 10^{-7}$ |
| $B_4 = -2.50405 \times 10^{-7}$. | |

The axial distance $Z_X$ and $Z_Y$ at the peripheral end points of the outside face on the X-Z plane and Y-Z plane, respectively, are given as follows:

| | |
|---|---|
| $Z_X$ | 20.111 (mm) and |
| $Z_Y$ | 13.979 (mm). |

Figure 4:
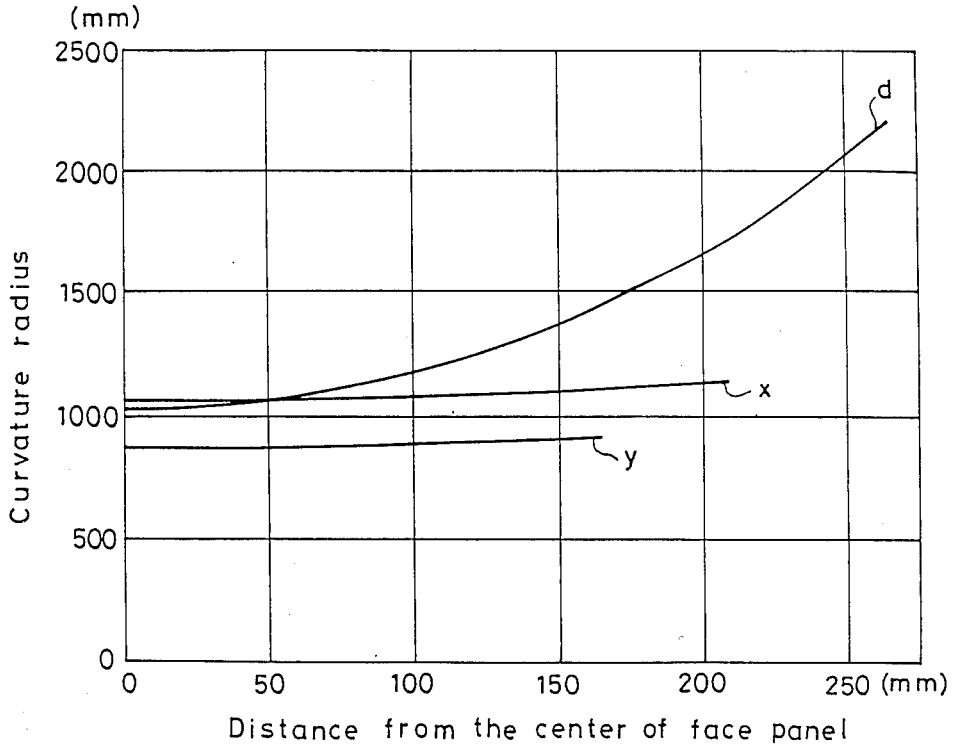
FIG. 4 is a graph showing radii of curvature of the face panel on cross-sections along a diagonal line, a horizontal axis and a vertical axis.

FIG. 1 is a contour diagram representing the curved face defined by the above-mentioned data. FIG. 4 is a graph showing radii of curvature on cross-sectional planes including the Z-axis, namely, cross-section on X-Z plane by curve x, on Y-Z plane by curve y and on diagonal-Z plane by curve d. As shown by the curves of FIG. 4, radius of curvature on the Y-Z plane is smallest, radius of curvature on X-Z plane is medium in the range where r is larger than about 60 mm, and the curvature on the diagonal-Z plane is largest. Furthermore, since the face has no point of inflection, there is no trouble of giving uncomfortable or unfamiliar feeling in observing reproduced image.

Figure 5:
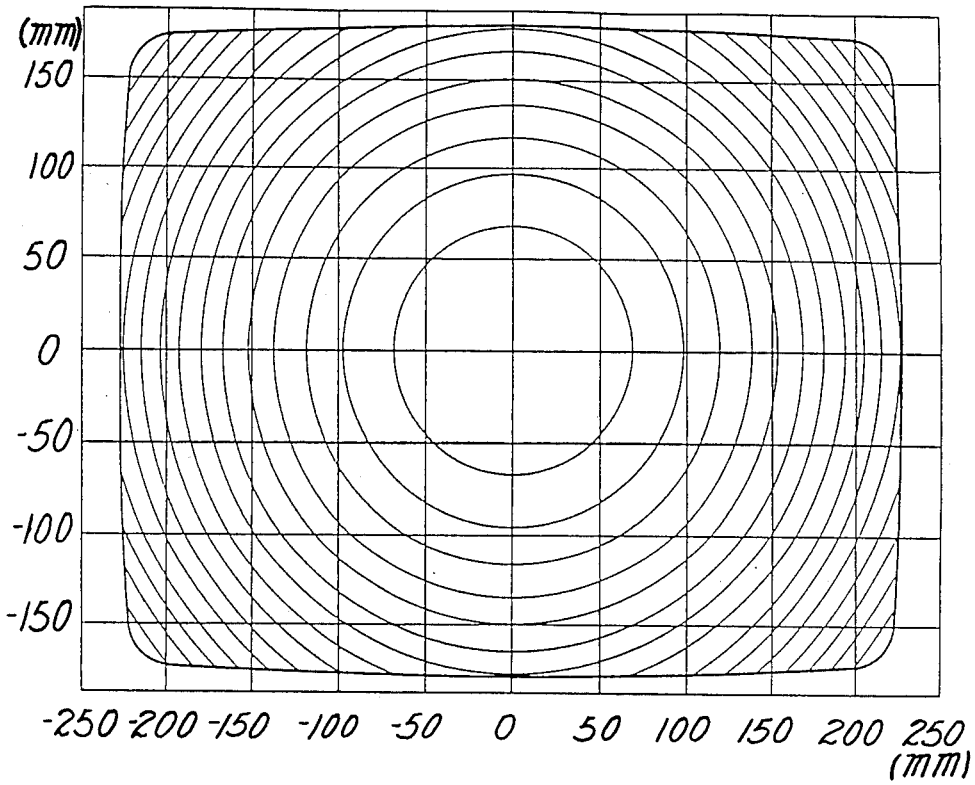
FIG. 5 (Prior Art)
FIG. 5 is the contour line diagram of the prior art face panel.
Figure 6:
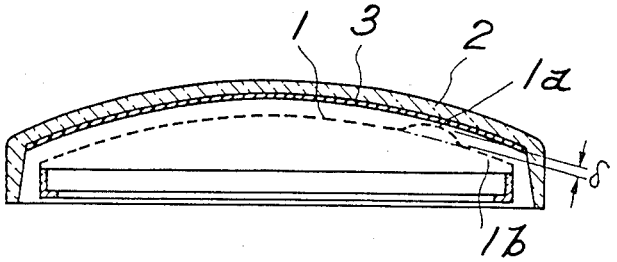
FIG. 6 (Prior Art)
FIG. 6 is the sectional view for explaining doming phenomenon of the conventional shadow mask.

Contour line diagram of the conventional face panel of simple spherical face having the same value of the above-mentioned $Z_D$ (=28.765 mm) as shown in FIG. 5 has the following axial distances:

| | |
|---|---|
| $Z_X$ | 18.452 (mm) |

-continued

| | |
|---|---|
| $Z_Y$ | 10.461 (mm). |

Accordingly, the values of $Z_D$–$Z_X$ and $Z_D$–$Z_Y$ are 10.313 (mm) and 18.304 (mm), respectively.

On the other hand, in the above-mentioned working example of the present invention, $Z_D$–$Z_X$ and $Z_D$–$Z_Y$ are 8.654 (mm) and 14.786 (mm), respectively, and therefore curvature at peripheral part of the face panel becomes considerably flat in comparison with the prior art.

In the preferred embodiment of the color picture tube, spacial configuration of the inside face of the face panel and the curved surface of the shadow mask should be formed in similarity with the non-spherical curved surface of the outside face of the face panel, so that electron beam permeability and uniformity of phosphor dot or stripe disposition are preferably achieved.

By the above-mentioned configuration of the face panel, the parts near the peripherals of the shadow mask are formed more flat than the central parts thereof, but there is no fear of making the doming phenomenon since the near-peripheral parts of the shadow mask has a considerably large heat conduction to the shadow mask frame and further the near peripheral area has a considerable strength because of fixing to the shadow mask frame, and therefore the doming phenomenon can be effectively suppressed.

What is claimed is:

1. A color picture tube comprising:

a vacuum enclosure having a face panel of a substantially rectangular shape having color phosphor dots or stripes on an inside face thereof, a shadow mask disposed in the enclosure with a predetermined gap to said inside face of the face panel, and means for emitting electrons including control means for controlling electron beam density, an outside face of said face panel having a hyperbolic curvature without a point of inflection and defined by the equation $$Z = \frac{\sqrt{A^2 + r^2} - A}{B}$$

wherein

Z is a distance in a direction of tube axis from a plane tangential at the center of the outside face to a point on the outside face, r is a distance of the tube axis to said point therealong, and A and B are values independent of r, respectively.

2. A color picture tube in accordance with claim 1, wherein curvatures $C_{Xr}$, $C_{Yr}$ and $C_{Dr}$ of said outer surface at the below-defined points $P_X$, $P_Y$ and $P_D$, respectively, have a relation substantially over the whole part of the face:

$$C_{Yr} > C_{Xr} > C_{Dr},$$

wherein said curvature $C_{Xr}$ is a curvature in a horizontal direction at a point which is apart from the center in horizontal direction by a distance r along said outside face, said curvature $C_{Yr}$ is a curvature in a vertical direction at a point which is apart from the center in vertical direction by a distance r along said outer face, and said curvature $C_{Dr}$ is a curvature in a diagonal direction at a point which is apart from the center in diagonal direction by a distance r along said outside face.

3. A color picture tube in accordance with claim 1, wherein A and B are variables having values dependent upon the angular position about the central axis of the color picture tube, but independent of r.

4. A color picture tube in accordance with claim 1, 2, or 5 wherein inside face of said face panel is formed in similar figure to the outside face of said face panel.

5. A color picture tube in accordance with claim 1, 2, or 5 wherein a curved surface of said shadow mask which is facing to said inside face of said face panel is formed in similarity to said outside face.

* * * * *